US006553871B2

(12) United States Patent
Sawyer et al.

(10) Patent No.: US 6,553,871 B2
(45) Date of Patent: Apr. 29, 2003

(54) FUSE TOOL

(75) Inventors: Michael Sawyer, Riverview, FL (US); Matthew Kusz, Minneapolis, MN (US); Fredrick Daniels, Floral City, FL (US); Christopher Kachurick, Plant City, FL (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 0 days.

(21) Appl. No.: 09/930,924

(22) Filed: Aug. 16, 2001

(65) Prior Publication Data

US 2003/0033908 A1 Feb. 20, 2003

(51) Int. Cl.[7] ..... B25B 27/14
(52) U.S. Cl. ..... 81/3.8; 81/53.1
(58) Field of Search ..... 81/3.8, 124.1, 81/53.1

(56) References Cited

U.S. PATENT DOCUMENTS 981,857 A * 1/1911 Hubbard et al. ..... 81/3.8
1,346,022 A * 7/1920 Hassel ..... 81/3.8
1,430,053 A * 9/1922 Bush ..... 81/3.8
1,927,528 A * 9/1933 Nilsson ..... 81/3.8
2,418,773 A * 4/1947 Kahanek ..... 81/3.8
2,454,878 A * 11/1948 Marler ..... 81/3.8
2,924,481 A * 2/1960 Wagstaff ..... 81/53.11
3,195,380 A * 7/1965 Bicks ..... 81/3.8
3,534,993 A * 10/1970 Le Vesque, Sr. ..... 81/3.8
5,800,043 A * 9/1998 Walkerow ..... 362/119

OTHER PUBLICATIONS

Michael Sawyer et al, U.S. Patent Application No. 09/851,799, "FUSE TOOL", filed May 9, 2001.

* cited by examiner

*Primary Examiner*—Joseph J. Hail, III
*Assistant Examiner*—David B. Thomas
(74) *Attorney, Agent, or Firm*—Fogg & Associates, LLC; Todd A. Myrum

(57) ABSTRACT

Embodiments of the present invention provide tools for installing and extracting fuses. In one embodiment, the tool has an elongate handle. A guideway spans the length of the handle, and a pair of jaws, adapted to retain the fuse, protrudes from an end of the handle. A rod is disposed within the guideway and is selectively actuatable within the guideway for releasing the fuse from the jaws.

74 Claims, 4 Drawing Sheets

FUSE TOOL

TECHNICAL FIELD

The present invention relates generally to the field of tools and, in particular, to a tool that can be used to install and extract fuses.

BACKGROUND

Fuses are often difficult to extract or install without using a tool because of their location or because of the force required to perform the installation or extraction. For example, many of the environmentally protected housings used by the telecommunications industry are located on utility poles or suspended from cables and contain a multitude of fuses. Typically, these fuses are accessible through access ports that are often smaller than the average adult hand and are often located several inches from the plane of the access port. Moreover, the fuses often have exposed electrically charged surfaces and/or are often surrounded by electrically charged surfaces.

Frequently, tools that are made from electrical conducting materials, that apply incorrect forces to the fuse, or the like are used for installing or extracting fuses, e.g., "needle-nose" pliers, screwdrivers, or the like. Using tools made from electrically conducting materials frequently cause the user to receive electrical shocks, cause electrical shorts that often damage electrical equipment, or the like. Using tools that apply incorrect forces frequently damage the fuses or the equipment to which the fuses are coupled or do not enable the installation or extraction of the fuse. Moreover, many of the tools conventionally used for installing and extracting fuses often require the user to use both hands and/or to apply a continuous force to the tool to maintain engagement of the tool and fuse. This is undesirable and causes safety issues when changing fuses located in housings that are located on utility poles or suspended from cables.

For the reasons stated above, and for other reasons stated below which will become apparent to those skilled in the art upon reading and understanding the present specification, there is a need in the art for tools for installing or extracting fuses that reduce the user's risk for electrical shocks, reduce the risk of electrical shorts, can be operated with one hand, and do not require the user to apply a continuous force to maintain engagement between the tools and the fuses.

SUMMARY

The above-mentioned problems with the tools used to install and extract fuses and other problems are addressed by embodiments of the present invention and will be understood by reading and studying the following specification. Embodiments of the present invention provide tools for installing and extracting fuses that reduce the user's risk for electrical shocks, reduce the risk of electrical shorts, can be operated with one hand, and do not require the user to apply a continuous force to the tools to maintain engagement between the tools and the fuses.

More particularly, in one embodiment, a tool for installing and extracting fuses is provided. The tool has an elongate handle. A guideway spans the length of the handle, and a pair of jaws, adapted to retain a fuse, protrudes from an end of the handle. A rod is disposed within the guideway and is selectively actuatable within the guideway for releasing the fuse from the jaws.

DETAILED DESCRIPTION

In the following detailed description, reference is made to the accompanying drawings that form a part hereof, and in which is shown by way of illustration specific illustrative embodiments in which the invention may be practiced. These embodiments are described in sufficient detail to enable those skilled in the art to practice the invention, and it is to be understood that other embodiments may be utilized and that logical, mechanical and electrical changes may be made without departing from the spirit and scope of the present invention. The following detailed description is, therefore, not to be taken in a limiting sense.

Embodiments of the present invention provide tools for installing and extracting fuses that reduce the user's risk for electrical shocks, reduce the risk of electrical shorts, can be operated with one hand, and do not require the user to apply a continuous force to the tool to maintain engagement between the tool and the fuse.

Figure 1:
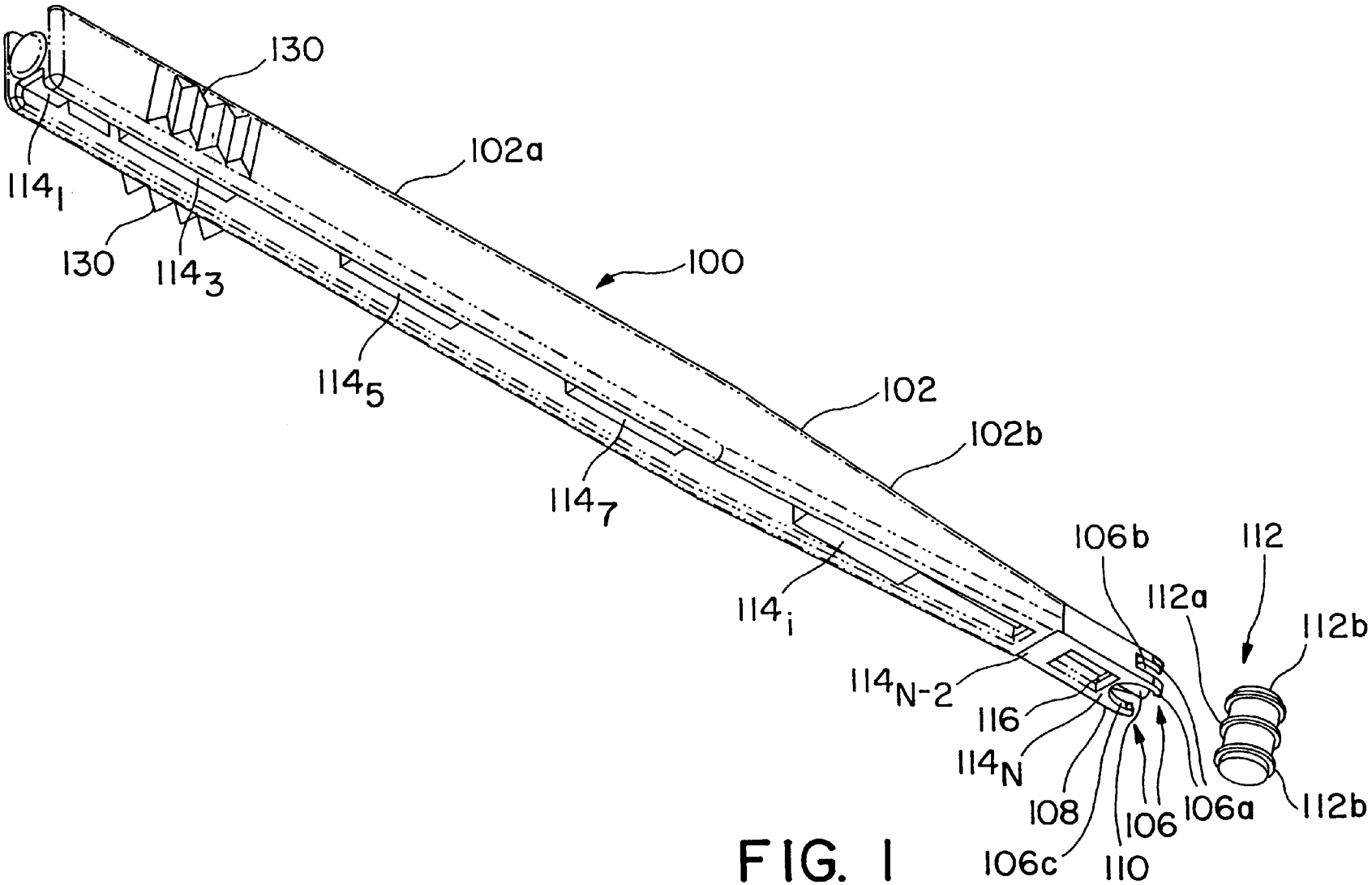
FIG. 1 is an isometric view of an embodiment of the present invention.
Figure 2:
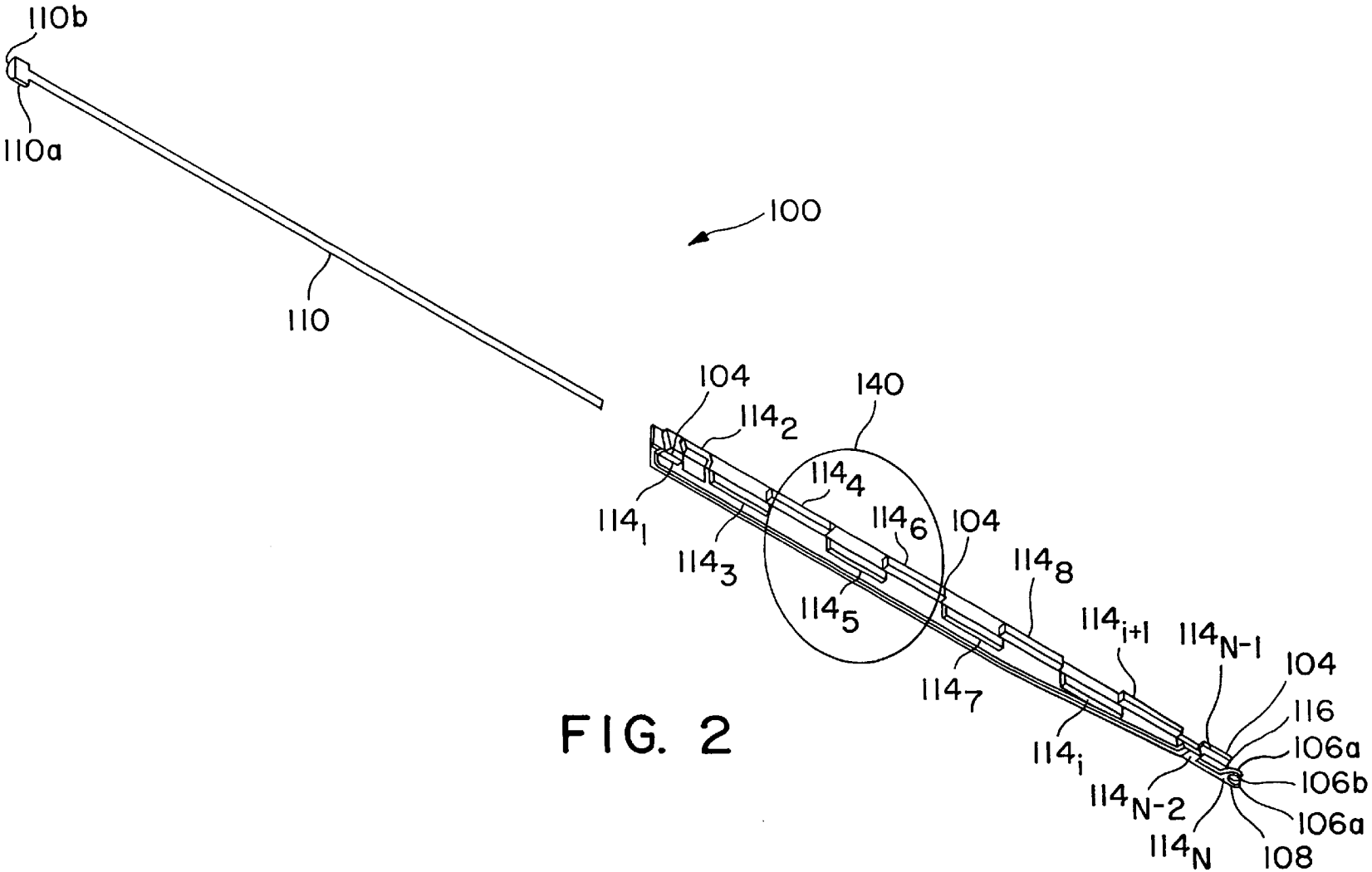
FIG. 2 is an exploded isometric cross-sectional view of an embodiment of the present invention.
Figure 3:
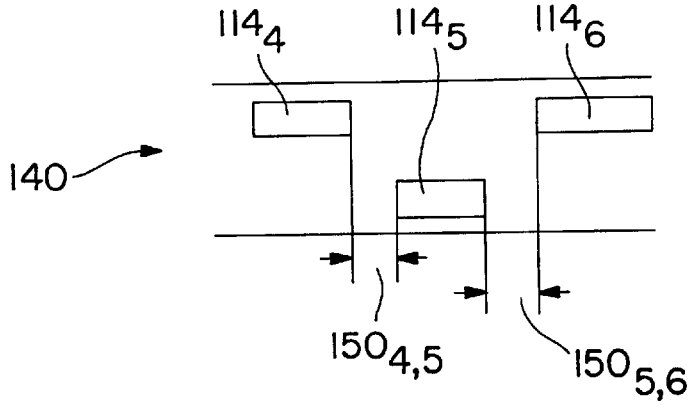
FIG. 3 is an enlarged view of region 140 of FIG. 2.
Figure 4:
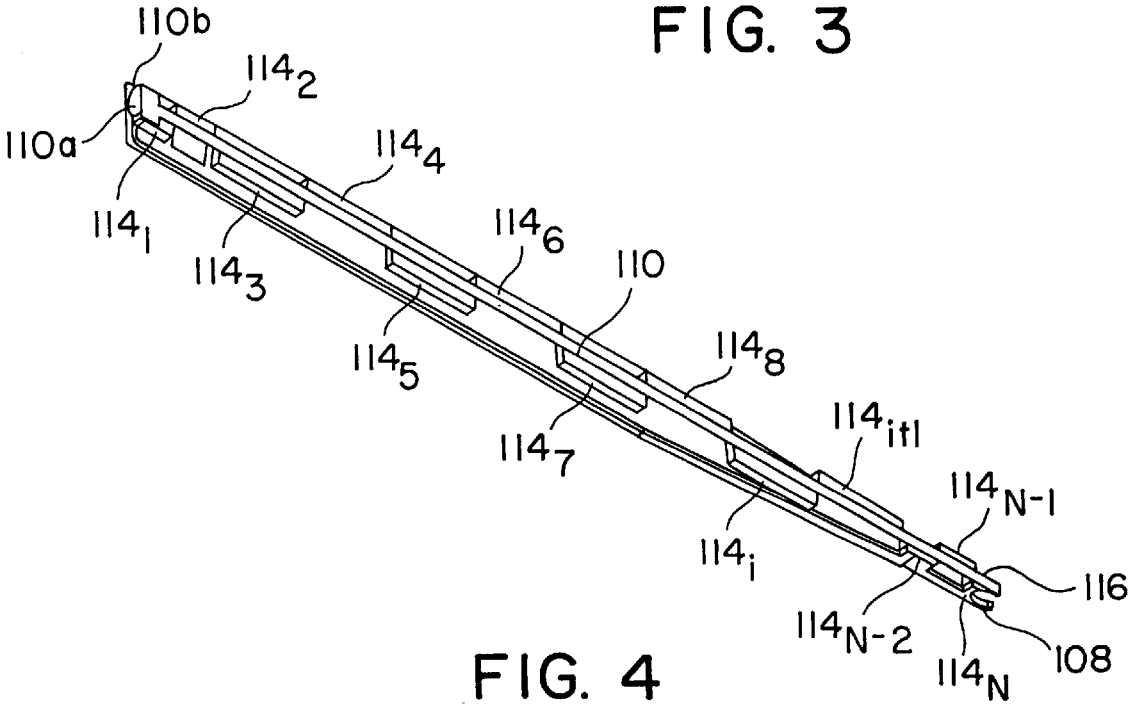
FIG. 4 is an isometric cross-sectional view of an embodiment of the present invention.
Figure 6:
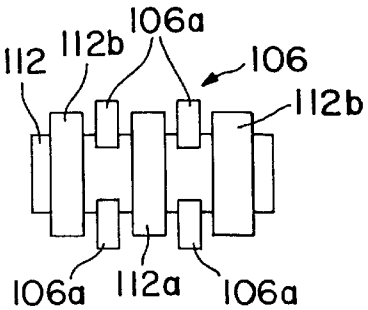
FIG. 6 is an enlargement of FIG. 5 as viewed from the right end.
Figure 8:
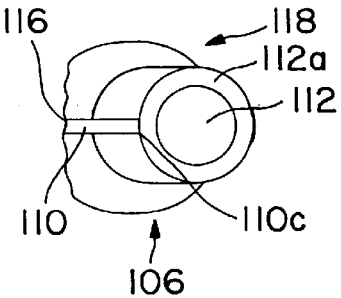
FIG. 8 is an enlarged view of region 118 of FIG. 7.
Figure 5:
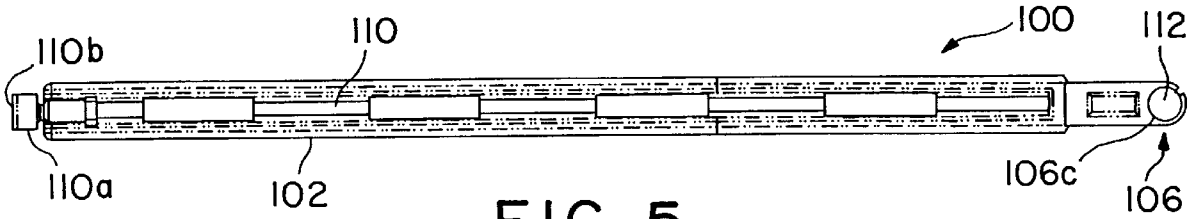
FIG. 5 is a side elevation view showing the jaws of an embodiment of the present invention retaining a fuse.
Figure 7:
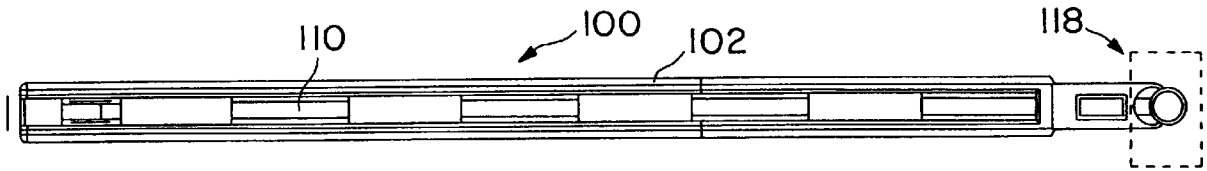
FIG. 7 is a side elevation view showing the jaws of an embodiment of the present invention sliding over a fuse.
Figure 9:
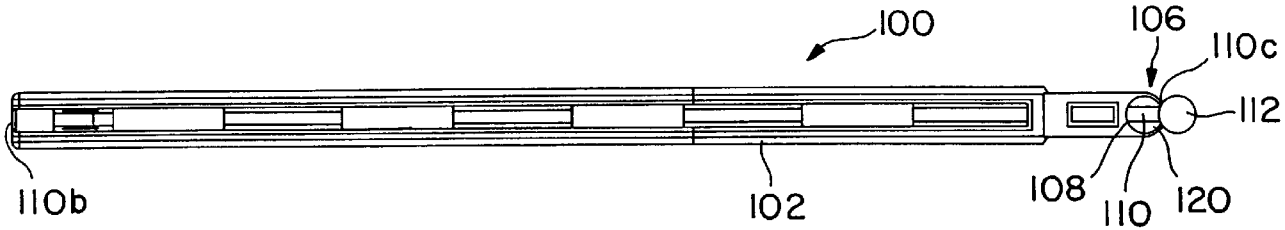
FIG. 9 is a side elevation view showing the jaws of an embodiment of the present invention receiving or releasing a fuse.

An embodiment of the present invention is exemplified by tool 100 in FIGS. 1–9. Tool 100 includes a handle 102. A guideway 104 spans the length of handle 102, as shown in FIG. 2. Tool 100 has a pair of jaws 106 protruding from an end 108 of handle 102. Jaws 106 are adapted to retain a fuse, such as fuse 112, as shown in FIGS. 5 and 6. Tool 100 also has a rod 110 that is disposed within guideway 104, as shown in FIG. 4, and is selectively actuatable within guideway 104. When a fuse, such as fuse 112, is retained between jaws 106, rod 110 is selectively actuated into engagement with the fuse for releasing the fuse from jaws 106, as shown in FIGS. 7 and 9.

Handle 102 and jaws 106, in one embodiment, are integral. In another embodiment, handle 102 includes a straight portion 102*a* of uniform width and a tapered portion 102*b* that tapers from straight portion 102*a* toward jaws 106, as shown in FIG. 1. Handle 102 and jaws 106 can be fabricated from any electrically nonconducting material having a suitable resiliency, such as glass-filled polycarbonate, glass-filled nylon, or the like. Handle 102 can be fabricated by molding, machining, or the like.

Rod 110 can be fabricated from any electrically nonconducting material, such as glass-filled polycarbonate, glass-filled nylon, or the like. In one embodiment, rod 110 has a head 110*a* at end 110*b* of rod 110, as shown in FIGS. 2, 4, and 5. Head 110*a* can be integral with rod 110, threaded onto rod 110, or the like. In another embodiment, head 110*a* is a magnet. Rod 110 can be fabricated by molding, machining, or the like.

Fuse 112 is shown in FIG. 1. Fuse 112 has central contact ring 112*a* that encircles and protrudes from the circumference of fuse 112 and a pair of contact rings 112*b* that encircle and protrude from the circumference of fuse 112 to straddle central contact ring 112*a*. Contact rings 112*a* and 112*b* electrically couple fuse 112 to various electrical circuits, such as circuits contained within environmentally protected housings, e.g., housings used by the telecommunications industry. In some applications, fuse 112 has three electrical leads instead of three contact rings.

Jaws 106 have arced profiles that have substantially the same radii. The radii of jaws 106 are substantially the same as the radius of fuse 112. Jaws 106 are sufficiently resilient to accommodate variations in the fuse radius, such as variations due to manufacturing, e.g., fuse radii can vary slightly from manufacturer to manufacturer.

Each of jaws 106 is forked and includes a pair of tines 106*a* separated by slot 106*b*, as shown in FIGS. 1 and 2. The tines of the respective jaws form a pair of substantially continuous arced surfaces 106*c* for bearing against a fuse, such as fuse 112, to retain the fuse. When fuse 112 is retained between jaws 106, tines 106*a* straddle central contact ring 112*a* and are respectively located between central contact ring 112*a*and one of contact rings 112*b*, and the pair of substantially continuous arced surfaces 106*c* bear against fuse 112, as shown in FIGS. 5 and 6.

Handle 102, in one embodiment, has several gripping elements 130 at straight portion 102*a* that are perpendicular to the longitudinal axis of handle 102, as shown in FIG. 1. It will be appreciated by those of ordinary skill in the art that any arrangement of gripping elements 130 that facilitates gripping tool 100 can be used, e.g., gripping elements 130 can have various profiles, such as triangular, truncated triangles, semi-circular, etc., gripping elements 130 can be oriented at an angle relative to the longitudinal axis of handle 102, or the like.

In one embodiment, handle 102 includes ribs $\mathbf{114}_1$ through $\mathbf{114}_N$, as shown in FIGS. 1–4. Ribs $\mathbf{114}_1$ through $\mathbf{114}_N$ alternate from side to side of handle 102 along the length of handle 102 to define guideway 104 FIG. 3 is an enlarged view of region 140 of FIG. 2. FIG. 3 demonstrates that in one embodiment, a longitudinal gap is provided between any pairs of successive alternating ribs, e.g., gap $\mathbf{150}_{4,5}$ between ribs $\mathbf{114}_4$ and $\mathbf{114}_5$ and gap $\mathbf{150}_{5,6}$ between the ribs $\mathbf{114}_5$ and $\mathbf{114}_6$. In some embodiments, the longitudinal extent of these gaps, e.g., gaps $\mathbf{150}_{4,5}$ and $\mathbf{150}_{5,6}$, is substantially zero, meaning there are no substantial gaps.

As seen in FIG. 4, ribs $\mathbf{114}_1$ through $\mathbf{114}_N$ straddle rod 110 when rod 110 is inserted in guideway 104. In another embodiment, a portion of rib $\mathbf{114}_{N-1}$ is directly opposite rib $\mathbf{114}_N$ at end 108 of handle 102 to define an aperture 116 at end 108, as shown in FIGS. 2 and 4. Aperture 116 is also shown, for one embodiment, in FIGS. 1 and 8. In another embodiment, rod 110 is in slidable contact with guideway 104 at rib $\mathbf{114}_1$ and at ribs $\mathbf{114}_{N-1}$ and $\mathbf{114}_N$. It will be appreciated by those skilled in the art that handle 102 can be solid, and guideway 104 can be a continuous axial bore within solid handle 102.

In operation, tool 100 grasps and releases a fuse, such as fuse 112. In one embodiment, the fuse is mounted at a substantially fixed position, for example, in a circuit, such as a telecommunications circuit contained in an environmental housing. To grasp fuse 112, a user positions jaws 106 adjacent fuse 112, as shown in FIG. 9, using handle 102. The user then applies an axial force to handle 102 in the direction of fuse 112 so that jaws 106 engage fuse 112 and slide over fuse 112. As jaws 106 slide over fuse 112, the resiliency of jaws 106 enables jaws 106 to be deflected apart by fuse 112, as shown in FIG. 8. Jaws 106 slide over fuse 112 until fuse 112 is retained between jaws 106, as shown in FIGS. 5 and 6. In one embodiment, the user then applies an axial force to handle 102 in a direction away from fuse 112 to pull fuse 112 from a circuit.

In another embodiment, a user grasps fuse 112 by holding handle 102 in one hand at a substantially fixed position and inserting fuse 112 between jaws 106 with the other hand. The user then applies an axial force to handle 102 that is directed toward fuse 112, in yet another embodiment, to push fuse 112 into a circuit.

In other embodiments, prior to grasping fuse 112, a portion of rod 110 adjacent end 110*c* of rod 110 protrudes from end 108 of handle 102 and into a space 120 between jaws 106, as shown in FIG. 9. As fuse 112 is grasped, as shown sequentially by FIGS. 9, 7, and 5, fuse 112 displaces the portion of rod 110 by bearing against end 110*c* to push the portion of rod 110 into handle 102 by moving rod 110 within guideway 104. In one embodiment, central contact ring 112*a* of fuse 112 bears against end 110*c* of rod 110, as shown in FIG. 8. In another embodiment, rod 110 is positioned as shown in FIG. 5 so that rod 110 does not protrude into space 120 prior to grasping the fuse.

To release a fuse, such as fuse 112, a user applies an axial force to rod 110 at end 110*b* in the direction of jaws 106. The force moves rod 110 within guideway 104 so that end 110*c* of rod 110 engages fuse 112 to push fuse 112 from jaws 106. In one embodiment, end 110*c* engages central contact ring 112*a* of fuse 112, as shown in FIG. 8. As rod 110 pushes fuse 112 from jaws 106, jaws 106 slide over fuse 112. As jaws 106 slide over fuse 112, the resiliency of jaws 106 enables jaws 106 to be deflected apart by fuse 112, as shown in FIG. 8. Jaws 106 continue to slide over fuse 112 until fuse 112 is released from jaws 106, as shown in FIG. 9. In one embodiment, fuse 112 is pushed from jaws 106 after fuse 112 is extracted from a circuit. In another embodiment, fuse 112 is pushed from jaws 106 after fuse 112 is inserted into a circuit.

CONCLUSION

Embodiments of the present invention have been described. The embodiments provide tools for installing and extracting fuses that reduce the user's risk for electrical shocks, reduce the risk of electrical shorts, can be operated with one hand, and do not require the user to apply a continuous force to the tools to maintain engagement between the tools and the fuses.

Although specific embodiments have been illustrated and described in this specification, it will be appreciated by those of ordinary skill in the art that any arrangement that is calculated to achieve the same purpose may be substituted for the specific embodiment shown. This application is intended to cover any adaptations or variations of the present invention. For example, the jaws can be modified to accommodate different types of fuses so that the tool is not limited to fuses of the type of fuse 112. Specifically, a continuous jaw can replace tines 106*a* of each of jaws 106. Moreover, the continuous jaws can each have a groove for accommodating a contact ring, such as central contact ring 112*a* of fuse 112. End 110*b* of rod 110 is not limited to being substantially flush with handle 102 when rod 110 protrudes into space 120, as shown in FIG. 9. Rather, end 110*b* can protrude from the handle 102 when rod 110 protrudes into space 120.

What is claimed is:

1. A tool comprising:

an elongate handle having a guideway spanning a length of the handle;

a pair of jaws integral with the handle and protruding from an end of the handle, the jaws adapted to retain a fuse; and a rod disposed within the guideway, the rod selectively actuatable within the guideway for releasing the fuse from the jaws.

2. The tool of claim 1, wherein the pair of jaws forms a substantially continuous arced profile having a radius that is substantially equal to the radius of the fuse.

3. The tool of claim 1, wherein each of the pair of jaws is forked.

4. The tool of claim 1, wherein each of the pair of jaws is resilient.

5. The tool of claim 1, wherein the rod is in slidable contact with at least a portion of the guideway.

6. The tool of claim 1, wherein the handle tapers toward the pair of jaws.

7. The tool of claim 1, wherein the handle comprises a straight portion and a tapered portion, the tapered portion tapering from the straight portion toward the pair of jaws.

8. The tool of claim 1, wherein the rod comprises a magnet at an end of the rod opposite the pair of jaws.

9. The tool of claim 1, wherein the handle comprises a plurality of ribs that alternate from side to side of the handle along the length of handle to define the guideway.

10. The tool of claim 9, wherein the plurality of ribs straddle the rod when the rod is disposed within the guideway.

11. The tool of claim 1, wherein the handle comprises a plurality of gripping elements.

12. A tool comprising:

an elongate handle, the handle comprising a plurality of ribs that alternate from side to side of the handle along a length of handle to define a guideway spanning the length of the handle;

a pair of jaws protruding from an end of the handle, the jaws adapted to retain a fuse; and a rod disposed within the guideway such that the plurality of ribs straddle the rod, the rod selectively actuatable within the guideway for releasing the fuse from the jaws.

13. The tool of claim 12, wherein the pair of jaws forms a substantially continuous arced profile having a radius that is substantially equal to the radius of the fuse.

14. The tool of claim 12, wherein each of the pair of jaws is forked.

15. The tool of claim 12, wherein each of the pair of jaws is resilient.

16. The tool of claim 12, wherein the rod is in slidable contact with at least one of the ribs.

17. The tool of claim 12, wherein the handle tapers toward the pair of jaws.

18. The tool of claim 12, wherein the handle comprises a straight portion and a tapered portion, the tapered portion tapering from the straight portion toward the pair of jaws.

19. The tool of claim 12, wherein the rod comprises a magnet at an end of the rod opposite the pair of jaws.

20. The tool of claim 12, wherein the handle comprises a plurality of gripping elements.

21. A tool comprising:

an elongate handle having a guideway spanning a length of the handle;

a pair of jaws integral with the handle and protruding from an end of the handle, the pair of jaws forming a substantially continuous arced surface for bearing against a fuse to retain the fuse; and a rod disposed within the guideway, the rod selectively actuatable within the guideway for releasing the fuse from the jaws.

22. The tool of claim 21, wherein each of the pair of jaws is forked and includes a pair of parallel tines, each tine having an arced profile.

23. The tool of claim 21, wherein each of the pair of jaws is resilient.

24. The tool of claim 21, wherein the rod is in slidable contact with at least a portion of the guideway.

25. The tool of claim 21, wherein the handle tapers toward the pair of jaws.

26. The tool of claim 21, wherein the handle comprises a straight portion and a tapered portion, the tapered portion tapering from the straight portion toward the pair of jaws.

27. The tool of claim 21, wherein the rod comprises a magnet at an end of the rod opposite the pair of jaws.

28. The tool of claim 21, wherein the handle comprises a plurality of ribs that alternate from side to side of the handle along the length of handle to define the guideway.

29. The tool of claim 28, wherein the plurality of ribs straddle the rod when the rod is disposed within the guideway.

30. The tool of claim 21, wherein the handle comprises a plurality of gripping elements.

31. A tool comprising:

an elongate handle having a guideway spanning a length of the handle;

a pair of forked resilient jaws protruding from an end of the handle, each jaw comprising a pair of parallel tines, each tine having an arced profile, the tines of the respective jaws forming a pair of substantially continuous arced surfaces for bearing against a fuse to retain the fuse; and a rod disposed within the guideway, the rod selectively actuatable within the guideway for releasing the fuse from the jaws.

32. The tool of claim 31, wherein the rod is in slidable contact with at least a portion of the guideway.

33. The tool of claim 31, wherein the handle tapers toward the pair of jaws.

34. The tool of claim 31, wherein the handle comprises a straight portion and a tapered portion, the tapered portion tapering from the straight portion toward the pair of jaws.

35. The tool of claim 31, wherein the rod comprises a magnet at an end of the rod opposite the pair of jaws.

36. The tool of claim 31, wherein the handle comprises a plurality of ribs that alternate from side to side of the handle along the length of handle to define the guideway.

37. The tool of claim 36, wherein the plurality of ribs straddle the rod when the rod is disposed within the guideway.

38. The tool of claim 31, wherein the handle comprises a plurality of gripping elements.

39. A tool comprising:

an elongate handle, the handle comprising a plurality of ribs that alternate from side to side of the handle along a length of handle to define a guideway spanning the length of the handle;

a pair of forked resilient jaws protruding from an end of the handle, each jaw comprising a pair of parallel tines, each tine having an arced profile, the tines of the respective jaws forming a pair of substantially continuous arced surfaces for bearing against a fuse to retain the fuse; and a rod disposed within the guideway such that the plurality of ribs straddle the rod, the rod selectively actuatable within the guideway for releasing the fuse from the jaws.

40. The tool of claim 39, wherein the rod is in slidable contact with at least one of the ribs.

41. The tool of claim 39, wherein the handle tapers toward the pair of jaws.

42. The tool of claim 39, wherein the handle comprises a straight portion and a tapered portion, the tapered portion tapering from the straight portion toward the pair of jaws.

43. The tool of claim 39, wherein the rod comprises a magnet at an end of the rod opposite the pair of jaws.

44. The tool of claim 39, wherein the handle comprises a plurality of gripping elements.

45. A method for grasping and releasing a fuse, the method comprising:

retaining the fuse between a pair of jaws protruding from an end of a handle; and pushing the fuse from the jaws by selectively actuating a rod within a guideway that spans a length of the handle.

46. The method of claim 45, wherein retaining the fuse comprises the pair of jaws forming a substantially continuous arced surface that engages a portion of the fuse.

47. The method of claim 45, wherein retaining the fuse comprises each of the jaws having a pair of parallel tines, each tine having an arced profile, wherein the tines of the respective jaws form a pair of substantially continuous arced surfaces that engage a portion of the fuse and straddle a central contact ring that encircles and protrudes from the fuse.

48. The method of claim 45, further comprising maintaining the handle at a substantially fixed position and applying a force to the fuse to insert the fuse between the jaws.

49. The method of claim 45, further comprising maintaining the fuse at a substantially fixed position and applying a force to the handle to move the jaws into engagement with the fuse.

50. The method of claim 45, wherein retaining the fuse comprises a portion of the rod protruding from the end of the handle and into a space between the jaws, wherein the fuse displaces the portion of the rod by pushing the portion of the rod into the handle.

51. The method of claim 45, wherein pushing the fuse comprises applying a force to the rod at an end of the rod opposite to the jaws.

52. The method of claim 45, wherein pushing the fuse comprises sliding the rod within the guideway.

53. The method of claim 45, further comprising extracting the fuse from a circuit before pushing the fuse from the jaws.

54. The method of claim 45, further comprising inserting the fuse into a circuit before pushing the fuse from the jaws.

55. A method for grasping and releasing a fuse, the method comprising:

retaining the fuse between a pair of jaws protruding from an end of a handle, each of the jaws having a pair of parallel tines, each tine having an arced profile, wherein the tines of the respective jaws form a pair of substantially continuous arced surfaces that engage a portion of the fuse; and pushing the fuse from the jaws by selectively actuating a rod within a guideway that spans a length of the handle.

56. The method of claim 55, further comprising maintaining the handle at a substantially fixed position and applying a force to the fuse to insert the fuse between the jaws.

57. The method of claim 55, further comprising maintaining the fuse at a substantially fixed position and applying a force to the handle to move the jaws into engagement with the fuse.

58. The method of claim 55, wherein retaining the fuse comprises a portion of the rod protruding from the end of the handle and into a space between the jaws, wherein the fuse displaces the portion of the rod by pushing the portion of the rod into the handle.

59. The method of claim 55, wherein pushing the fuse comprises applying a force to the rod at an end of the rod opposite to the jaws.

60. The method of claim 55, wherein pushing the fuse comprises sliding the rod within the guideway.

61. The method of claim 55, further comprising extracting the fuse from a circuit before pushing the fuse from the jaws.

62. The method of claim 55, further comprising inserting the fuse into a circuit before pushing the fuse from the jaws.

63. A method for extracting a fuse from a circuit, the method comprising:

retaining the fuse between a pair of jaws protruding from an end of a handle;

applying a force to the handle to pull the fuse from the circuit; and pushing the fuse from the jaws by selectively actuating a rod within a guideway that spans a length of the handle.

64. The method of claim 63, wherein pushing the fuse comprises applying a force to the rod at an end of the rod opposite to the jaws.

65. The method of claim 63, wherein pushing the fuse comprises sliding the rod within the guideway.

66. The method of claim 63, wherein retaining the fuse comprises the pair of jaws forming a substantially continuous arced surface that engages a portion of the fuse.

67. The method of claim 63, wherein retaining the fuse comprises each of the jaws having a pair of parallel tines, each tine having an arced profile, wherein the tines of the respective jaws form a pair of substantially continuous arced surfaces that engage a portion of the fuse and straddle a central contact ring that encircles and protrudes from the fuse.

68. The method of claim 63, wherein retaining the fuse comprises moving the jaws into engagement with the fuse using the handle.

69. A method for inserting a fuse into a circuit, the method comprising:

retaining the fuse between a pair of jaws protruding from an end of a handle;

applying a force to the handle to push the fuse into the circuit; and pushing the fuse from the jaws by selectively actuating a rod within a guideway that spans a length of the handle.

70. The method of claim 69, wherein pushing the fuse from the jaws comprises applying a force to the rod at an end of the rod opposite to the jaws.

71. The method of claim 69, wherein pushing the fuse from the jaws comprises sliding the rod within the guideway.

72. The method of claim 69, wherein retaining the fuse comprises the pair of jaws forming a substantially continuous arced surface that engages a portion of the fuse.

73. The method of claim 69, wherein retaining the fuse comprises each of the jaws having a pair of parallel tines, each tine having an arced profile, wherein the tines of the respective jaws form a pair of substantially continuous arced surfaces that engage a portion of the fuse and straddle a central contact ring that encircles and protrudes from the fuse.

74. The method of claim 69, wherein retaining the fuse comprises placing the fuse between the jaws.

* * * * *